US006280270B1

(12) United States Patent
Neisen

(10) Patent No.: US 6,280,270 B1
(45) Date of Patent: Aug. 28, 2001

(54) ASSEMBLY AND METHOD FOR ROUTING EXHAUST THROUGH A GIMBAL IN A STERN DRIVE

(75) Inventor: Gerald F. Neisen, Rockport, TX (US)

(73) Assignee: Bombardier Motor Corporation of America, Grant, FL (US)

( * ) Notice: Subject to any disclaimer, the term of this patent is extended or adjusted under 35 U.S.C. 154(b) by 0 days.

(21) Appl. No.: 09/603,044

(22) Filed: Jun. 26, 2000

(51) Int. Cl.[7] ..... B63H 21/32
(52) U.S. Cl. ..... 440/89; 60/310
(58) Field of Search ..... 440/89, 88; 60/310

(56) References Cited

U.S. PATENT DOCUMENTS 3,181,494 * 5/1965 Kiekhaefer et al. ..... 440/89
4,504,238 3/1985 Neisen ..... 440/89
4,734,071 3/1988 Zemlicka et al. ..... 440/89
4,831,822 5/1989 Yoshimura ..... 440/89
5,083,952 1/1992 Bland et al. ..... 440/89
5,295,881 3/1994 Breckenfeld et al. ..... 440/89
6,022,254 2/2000 Neisen ..... 440/89

* cited by examiner

*Primary Examiner*—Jesus D. Sotelo
(74) *Attorney, Agent, or Firm*—Timothy J. Ziolkowski; Cook & Franke S.C.

(57) ABSTRACT

A propulsion system made up of an engine located in the interior of a marine vessel is provided. The engine has an exhaust discharge member in communication with a propulsion unit. A gimbal ring has a pivotable exhaust passage connected to pass exhaust from the discharge member to the propulsion unit.

40 Claims, 3 Drawing Sheets

ASSEMBLY AND METHOD FOR ROUTING EXHAUST THROUGH A GIMBAL IN A STERN DRIVE

BACKGROUND OF THE INVENTION

The present invention is generally related to marine propulsion systems, and, more particularly, the present invention is related to through gimbal exhaust assemblies and techniques that may be used in a stern drive marine propulsion system.

Present technology for exhaust systems in stem drives either routes exhaust overboard through the transom or through the propeller underwater. Through prop exhaust is somewhat quieter relative to overboard exhaust systems since the exit is underwater and generally far from the boat interior and the exhaust is within the vortex of the propeller. FIG. 2 shows a cross-sectional view of a typical prior art exhaust system arrangement that uses a flexible bellows 50 for passing exhaust from an internal combustion engine to a passageway in a propulsion unit for discharge through the propeller. The exhaust may typically comprise exhaust gases and cooling water to avoid high temperature conditions which could burn the bellows. As shown in FIG. 2, bellows 50 comprises a plurality of circumvolutions that allows bellows 50 to be flexibly extended for allowing respective pivotal motion of propulsion unit 14 about a generally vertical steering axis, and about a generally horizontal tilt/trim axis. As further shown in FIG. 2, a separate flexible bellows 52 encloses a universal joint 54 that allows for transmitting rotating power from the engine to the propulsion unit in fashion well-understood by those skilled in the art. It will be appreciated that the exhaust bellows arrangement should be reliable as such arrangement allows for containing the exhaust and noise during various trim and/or steering conditions. This prior art arrangement works generally satisfactory for most conditions. However, during periods of high volume of exhaust flow, such as during periods of high engine load, the circumvolutions in the interior of the bellows, as represented by the curls in the interior of bellows 50, may result in an undesirably high level of friction in the exhaust that flows in the bellows. The high friction in turn may cause a relatively high level of exhaust back pressure which results in reduced engine efficiency.

Manufacturers of marine propulsion systems have attempted to solve the foregoing issues but some of these attempts may have their own side effects. For example, the following two prior art arrangements may have somewhat helped to reduce back pressure but each is believed to suffer from increased exhaust noise or exhaust leakage, or both. One of such exhaust arrangements allows for providing transom exhaust relief holes for discharging exhaust ahead of the bellows. The other prior art exhaust arrangement, once used but abandoned because of its side effects, substituted two straight slip-together rubber tubes, in lieu of a flexible bellows, to carry the exhaust. Unfortunately, such arrangement, like the one with exhaust relief holes, resulted in leaking exhaust and noise during various trim and steering conditions.

In view of the foregoing discussion, it is desirable to provide a gimbal assembly that can be produced and maintained at a low cost and that avoids such side effects while reducing exhaust flow friction so as to reduce exhaust back pressure and achieve high engine efficiency without creating loud exhaust noise during high engine load, or annoying "burping" noises during engine idling conditions.

SUMMARY OF THE INVENTION

Generally speaking, the foregoing needs are fulfilled in one exemplary embodiment by providing a propulsion system made up of an engine located in the interior of a marine vessel. The engine has an exhaust discharge member in communication with a propulsion unit. A gimbal ring has a pivotable exhaust passage connected to pass exhaust from the discharge member to the propulsion unit.

The present invention further fulfills the foregoing needs by providing in another exemplary embodiment an exhaust assembly for a stern drive having an engine located in the interior of a boat. The engine has an exhaust discharge member in communication with a propulsion unit. The assembly comprises a gimbal ring having an exhaust passage connected to pass exhaust from the discharge member to the propulsion unit. The exhaust passage comprises a first transfer area pivotally connected between a gimbal housing and the gimbal ring. The exhaust passage further comprises a second transfer area pivotally connected between a pivot housing and the gimbal ring.

Figure 1:
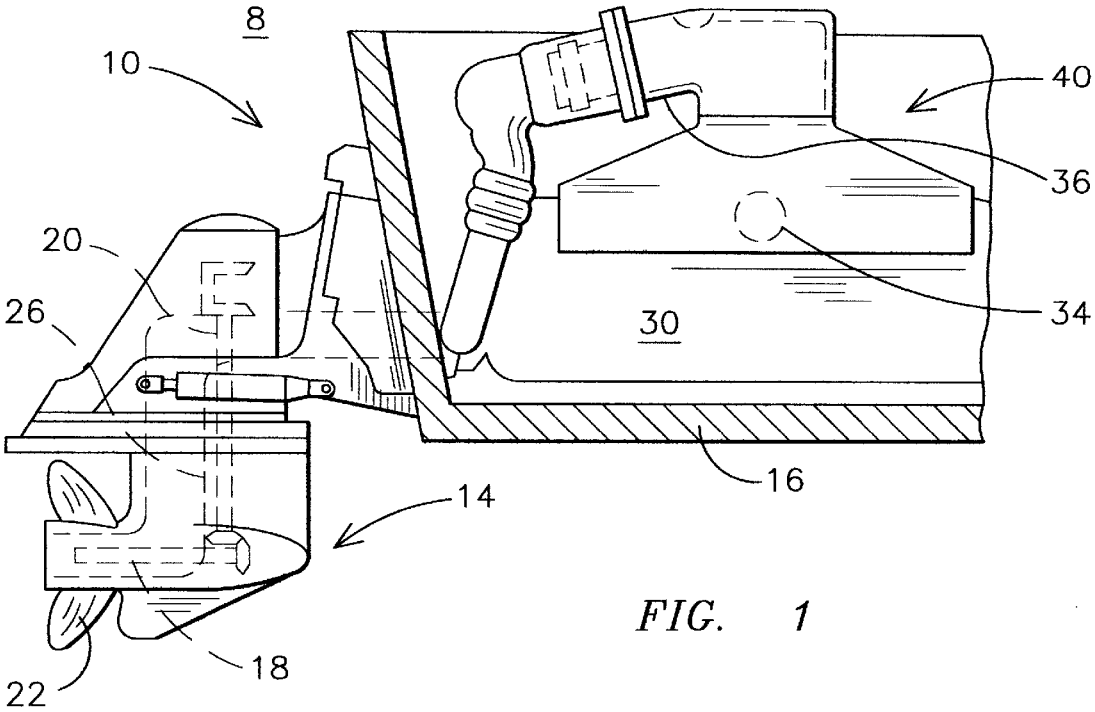
FIG. 1 is a partial side elevational view, partially broken away, of a marine propulsion system embodying the present invention.
Figure 2:
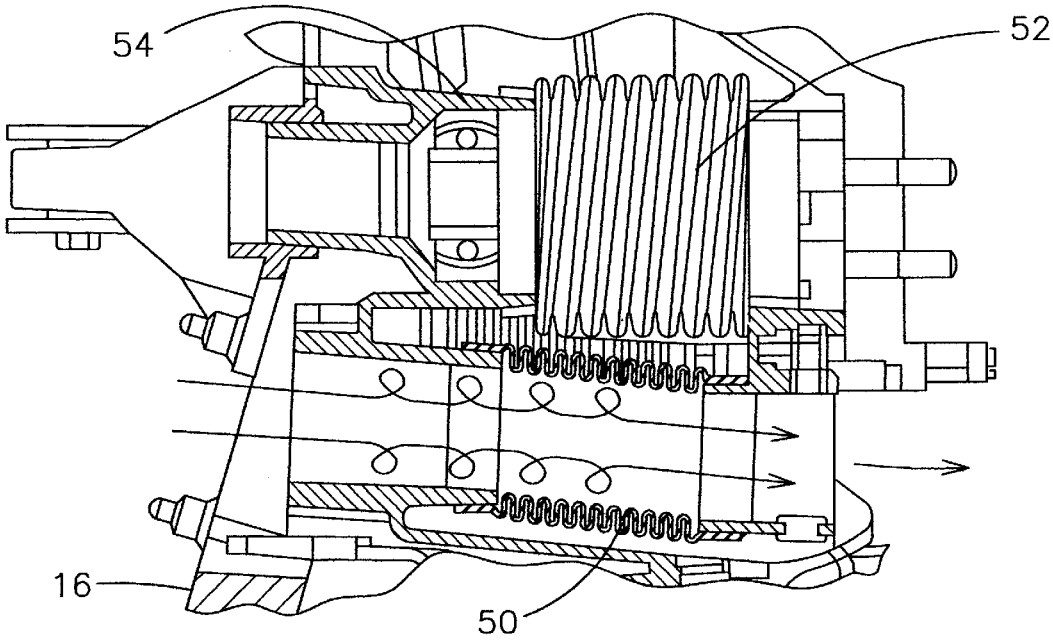
FIG. 2 PRIOR ART
FIG. 2 is a partial cross-sectional view of one common prior art exhaust bellows arrangement.

Before any embodiment of the invention is explained in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DETAILED DESCRIPTION OF THE INVENTION

FIG. 1 illustrates an exemplary marine propulsion system 8 embodying the present invention. While the invention is described in the context of a stern drive unit 10, it should be understood that the invention is applicable to other types of marine propulsion systems, and to other devices including internal combustion engines.

The stem drive unit 10 includes a propulsion unit 14 mounted on a boat 16 for pivotal movement relative thereto about a generally vertical steering axis and about a generally horizontal tilt axis. The propulsion unit 14 includes a drive shaft 20 coupled through suitable gears to a propeller shaft 18 having thereon a propeller 22. The propulsion unit 14 also includes an exhaust passageway 26 which, as is known in the art, passes through the hub of the propeller 22.

The stern drive unit 10 also comprises an internal combustion engine 30 mounted within the boat 16 and drivingly connected to the propeller shaft 18 in a known manner. The internal combustion engine 30 includes a plurality of exhaust ports 34 (one is shown in FIG. 1). The stern drive unit 10 also comprises an exhaust discharge member 40 communicating between the engine exhaust ports 34 and the propulsion unit exhaust passageway 26 by way of a exhaust passage 120 (FIG. 3) constructed through a gimbal ring 102 (FIG. 3) as described below.

Figure 3:
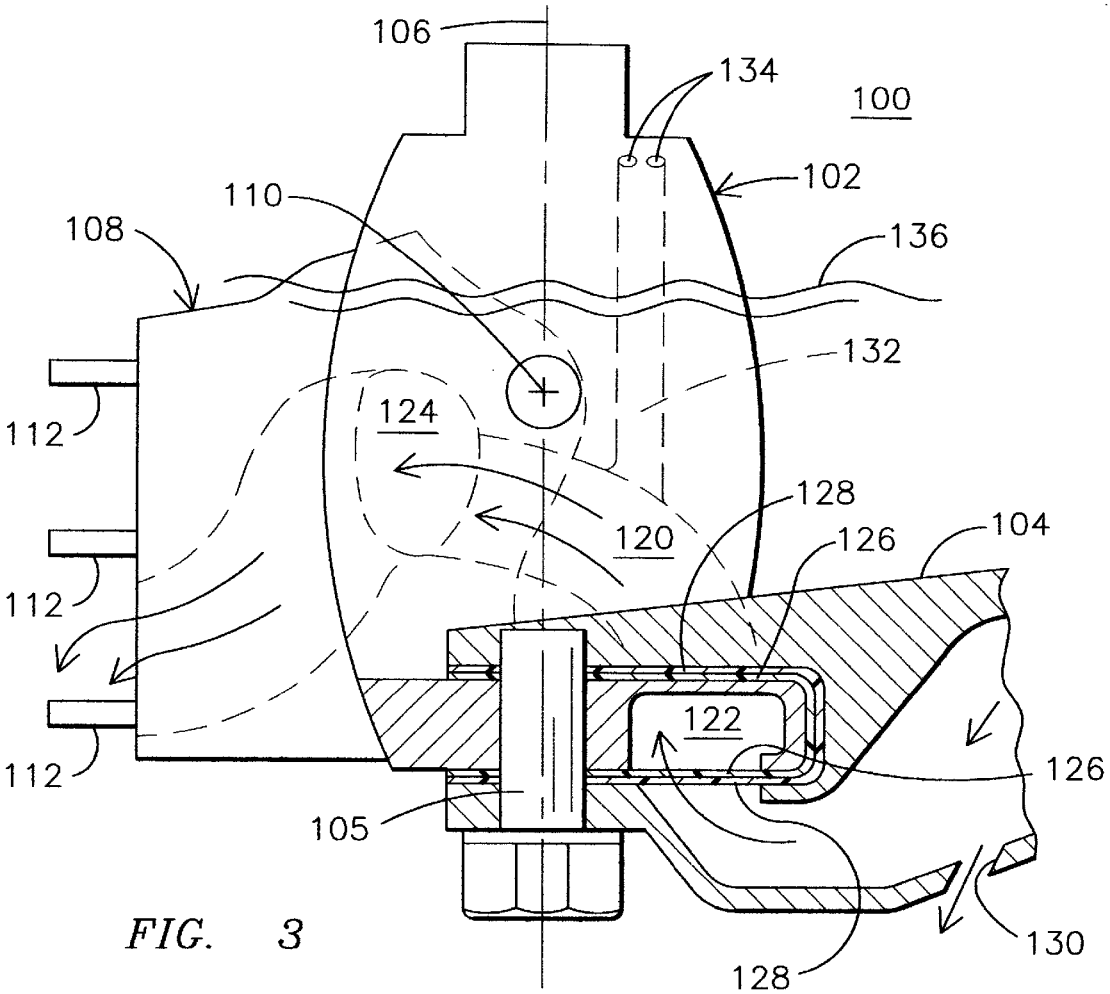
FIG. 3 is a partial cross-sectional side view of one exemplary exhaust passage through a gimbal ring embodying one aspect of the present invention.

As shown in FIG. 3, the marine propulsion system 8 also comprises a gimbal unit 100 including a gimbal ring 102 connected to a gimbal housing having a respective upper mounting arm (not shown) and a lower mounting arm 104 receiving a suitable pivot pin 105 for pivotal support about a generally vertical steering axis 106. Gimbal unit 100 further comprises a pivot housing 108 connected to the gimbal ring 102 for pivotal movement about a generally horizontal tilt-trim axis 110. The propulsion unit 14 (FIG. 1) may be removably connected to the pivot housing 108 for common pivotal movement of propulsion unit 14 with pivot housing 108. In the illustrated construction, propulsion unit 14 is removably connected to pivot housing 108 by a plurality of bolts 112. Such a construction is well known in the art and will not be described in detail other than as necessary for an understanding of the present invention.

In one key feature of the present invention, gimbal ring 102 includes a pivotable exhaust passage 120 integrally constructed through the gimbal ring. As shown in FIG. 3, exhaust passage 120 includes a first transfer area 122 pivotally connected between the gimbal ring and the gimbal housing, e.g., lower mounting arm 104. Exhaust passage 120 further includes a second transfer area 124 pivotally connected between pivot housing 108 and gimbal ring 102. By way of example, the first transfer area may be pivotable about steering axis 106 while the second transfer area may be pivotable about tilt-trim axis 110. Second transfer area 124 may be configured to enable passage of a relatively high amount of exhaust when the propulsion unit is operated in a generally trimmed down condition, such as may be desirable during cruising speeds when the engine may be operated at full or at a relatively high power condition. First transfer area 122 may be configured to enable passage of a relatively high amount of exhaust when the propulsion unit is operated in a generally straight steering condition since usually the engine is not operated at full or high power as the boat is turning. One exemplary configuration for each transfer area may be a crescent-shape. It will be appreciated that other configurations could also be employed depending on tradeoffs available to the designer, such as spacing constraints, boating application, engine size, etc. Examples of other configurations for the transfer areas may be, elliptical, circular, etc.

To facilitate the pivotal motion at the respective transfer areas, corresponding bushing members (e.g., 126 and 128), such as made of plastic or other suitable polymer, may be provided at each transfer area to reduce metal-to-metal contact since the gimbal ring, gimbal housing and pivot housing may each be made of a metal or alloy that exhibits high resistance to corrosion while being light weight and of high strength, such as aluminum.

As will be appreciated by those skilled in the art, as cooling water travels in the exhaust discharge member with exhaust gases, such water may be separated by a standard water separator due to centrifugal force. As shown in FIG. 3, an outlet 130 is provided in lower mounting arm 104 to allow passage of liquid exhaust ahead of the first transfer area. Thus, the exhaust passing through the gimbal ring may be primarily gaseous exhaust. It will be understood, however, that the exhaust passing through the gimbal ring need not be limited to gaseous exhaust. In geographical regions having a cold climate, outlet 130 may also prevent water from remaining in the exhaust system, which if exposed to freezing temperatures could lead to expensive damage.

In another feature of the present invention, if desired, a passageway 132 may be provided in communication with exhaust passage 120 to permit venting through one or more orifices 134 to the exhaust passage. The venting orifices may be arranged to be above the water line 136 on the exterior of the boat as the engine is operated in an idling condition.

In one exemplary embodiment, gimbal ring 102 and the various internal passages, e.g., exhaust passage 120, venting passageway 132, etc., in its interior comprise one integral unit that may be constructed using well-known and readily understood casting techniques to those of ordinary skill in the art, e.g., die casting, sand casting, etc. It will be appreciated that the internal passages could in the alternative be bored in the gimbal ring using standard drilling techniques, or, as suggested above, may be configured while the assembly is cast using a mold configured to define such internal passages.

Figure 4:
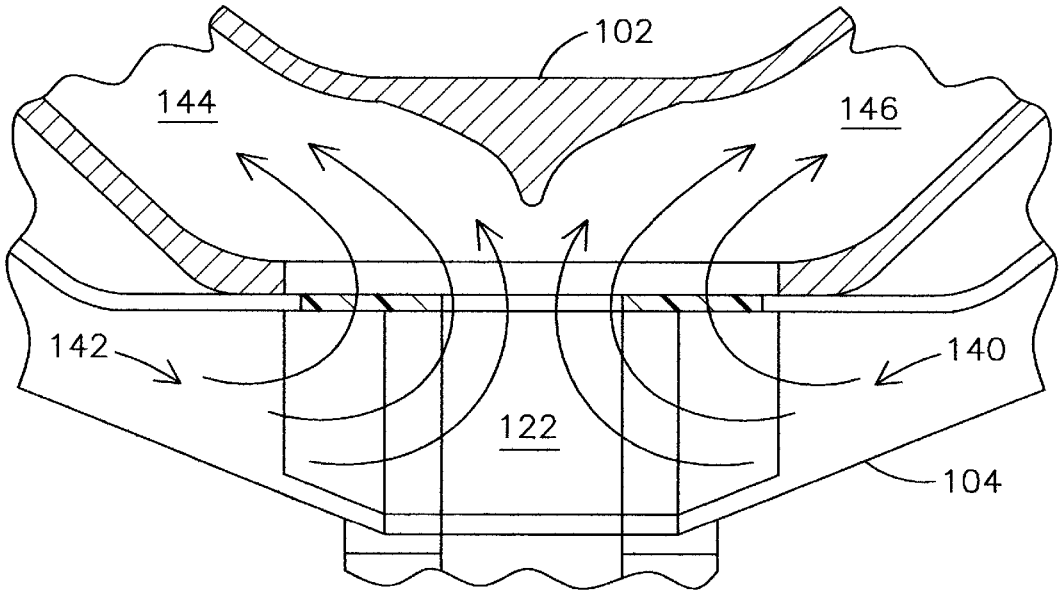
FIG. 4 is a top view of an exemplary pivotable transfer area in the exhaust passage of FIG. 3.
Figure 5:
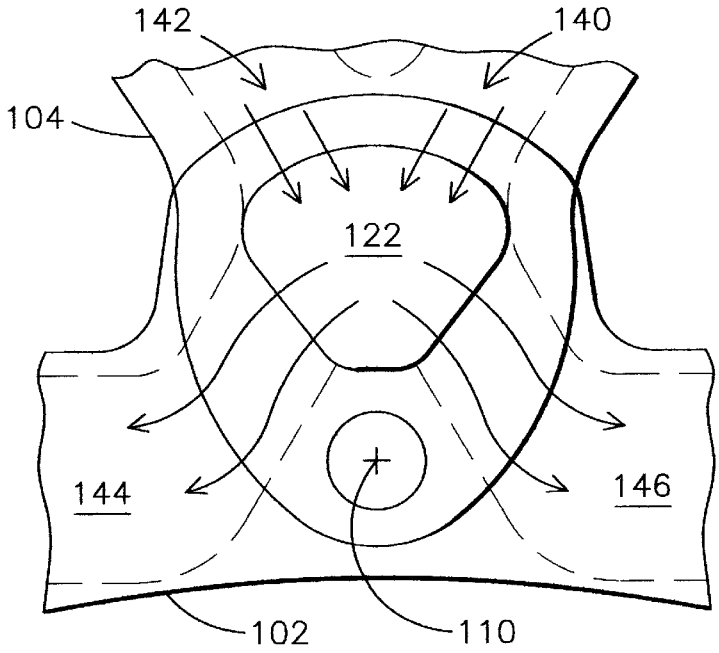
FIG. 5 is a partial cross-sectional front view of another exemplary transfer area in the exhaust passage of FIG. 3.

As best seen in FIGS. 4 and 5, in one exemplary embodiment first transfer area 122 may comprise a multiple inlet port relative to the exhaust from the engine, such as made up of inlet ports 140 and 142. Further exhaust passage 120 may comprise respective branches 144 and 146 that split from the first transfer area 122 through a respective lateral section of the gimbal ring. As shown in FIG. 4, in one exemplary embodiment first transfer area 122 receives the exhaust flow from below whereas in the exemplary embodiment of FIG. 5, first transfer are 122 receives the exhaust from above. It is believed that the exemplary embodiment of FIG. 4, may result in smoother flow since the flow does not experience a relative drastic change in direction. In one exemplary embodiment, assuming two inlet ports and two exhaust branches, the size of the transfer area at full opening may be about 7 $in^2$ while the size of each inlet and exhaust branch may be about 3.5 $in^2$ or one half of the size of the transfer area. It will be appreciated that the present invention need not be limited to two inlet ports or two exhaust branches nor is the present invention limited to the above exemplary dimensions.

Figure 6:
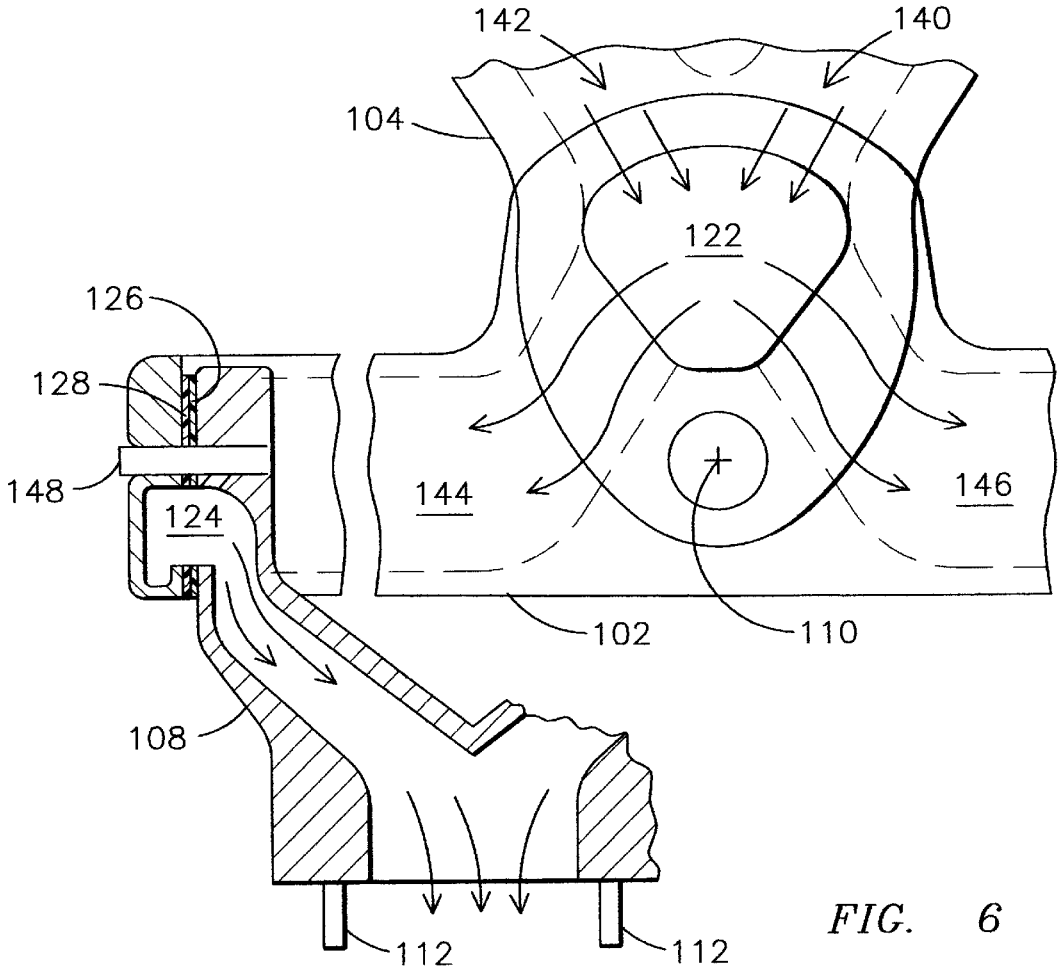
FIG. 6 is a partial cross-sectional view illustrating an exemplary connection between respective pivotable transfer areas in the gimbal ring.

FIG. 6 shows a cross-sectional view that provides further details of one exemplary connection of respective transfer areas 122 and 124 through exhaust branch 144. Although not shown for the purpose of avoiding unnecessary redundancy, it will be appreciated that another transfer area operationally identical to transfer area 124 may be provided on the opposite side of the gimbal ring (right hand side of the drawing) for connecting exhaust branch 146 to pass exhaust into passageway 26 (FIG. 1) for eventual discharge through the propeller of the drive. In this case, respective lateral pivot pins (e.g., 148) may be used for pivotally supporting the gimbal ring for pivotal movement about tilt-trim axis 110 (FIG. 3). Thus, in the case of dual exhaust branches 144 and 146 within each respective side of the gimbal ring, after being pivotable connected relative to the pivot housing through each respective second pivotable transfer area on each side of the gimbal ring, e.g., transfer area 124, such branches may eventually rejoin to allow discharge through the propeller of the stern drive. It will be appreciated that there may be applications where such rejoining is not implemented, such as in the case of a propulsion system with dual propellers.

In operation the present invention provides a substantially reliable pivotable exhaust passage not susceptible to burning in the absence of cooling water, or to degradation due to environmental exposure or marine microorganisms, such as barnacles, etc. Further, the exhaust passage of the present invention being integrally constructed through the gimbal ring is believed to exhibit superior acoustical insulating properties in view of the surrounding gimbal ring mass that absorbs a large portion of the acoustical energy that otherwise would leak to the outside and eventually to users in the boat.

It will be understood that the specific embodiment of the invention shown and described herein is exemplary only. Numerous variations, changes, substitutions and equivalents will now occur to those skilled in the art without departing from the spirit and scope of the present invention. Accordingly, it is intended that all subject matter described herein and shown in the accompanying drawings be regarded as illustrative only and not in a limiting sense and that the scope of the invention be solely determined by the appended claims.

What is claimed is:

1. A propulsion system comprising:

an engine located in the interior of a marine vessel, the engine having an exhaust discharge member in communication with a propulsion unit; and a gimbal ring having a pivotable exhaust passage connected to pass exhaust from the discharge member to the propulsion unit and wherein the exhaust passage is integrally constructed in the gimbal ring.

2. A propulsion system comprising:

an engine located in the interior of a marine vessel, the engine having an exhaust discharge member in communication with a propulsion unit; and a gimbal ring having a pivotable exhaust passage connected to pass exhaust from the discharge member to the propulsion unit and wherein the exhaust passage comprises a first transfer area pivotally connected between a gimbal housing and the gimbal ring.

3. The propulsion system of claim 2 wherein the first transfer area is pivotable about a respective steering axis.

4. The propulsion system of claim 2 wherein the exhaust passage comprises a second transfer area pivotally connected between a pivot housing and the gimbal ring.

5. The propulsion system of claim 4 wherein the second transfer area is pivotable about a respective tilt-trim axis.

6. The propulsion system of claim 4 wherein the second transfer area is configured to pass a relatively high amount of exhaust during periods when the propulsion unit is operated in a generally trimmed down condition.

7. The propulsion system of claim 4 wherein each respective transfer area comprises corresponding bushing members to facilitate its respective pivoting motion.

8. The propulsion system of claim 4 wherein the second transfer area comprises an outlet port relative to the exhaust passing through the gimbal ring to the propulsion unit.

9. The propulsion system of claim 2 wherein the first transfer area is configured to pass a relatively high amount of exhaust during periods when the propulsion unit is operated in a generally straight steering condition.

10. The propulsion system of claim 2 wherein the gimbal housing comprises an outlet configured to allow liquid exhaust to pass therethrough ahead of the first transfer area.

11. The propulsion system of claim 10 further comprising a passageway in communication with the exhaust passage, the passageway terminating in one or more venting orifices.

12. The propulsion system of claim 11 wherein the venting orifices are arranged to be above the water line on the exterior of the vessel as the engine is operated in an idling condition.

13. The propulsion system of claim 2 wherein the exhaust passage is integrally constructed in the gimbal ring.

14. The propulsion system of claim 13 wherein the exhaust passage is constructed by casting the gimbal ring.

15. The propulsion system of claim 13 wherein the exhaust passage is constructed by drilling the gimbal ring.

16. The propulsion system of claim 2 wherein the first transfer area comprises an inlet port relative to the exhaust from the engine.

17. The propulsion system of claim 2 wherein the first transfer area comprises a multiple inlet port relative to the exhaust from the engine.

18. The propulsion system of claim 2 wherein the exhaust passage comprises respective exhaust branches that split from the first transfer area through a respective lateral section of the gimbal ring.

19. An exhaust assembly for a stern drive having an engine located in the interior of a boat, the engine having an exhaust discharge member in communication with a propulsion unit, the assembly comprising:

a gimbal ring having an exhaust passage connected to pass exhaust from the discharge member to the propulsion unit, the exhaust passage comprising a first transfer area pivotally connected between a gimbal housing and the gimbal ring, the exhaust passage further comprising a second transfer area pivotally connected between a pivot housing and the gimbal ring.

20. The exhaust assembly of claim 19 wherein the first transfer area is pivotable about a respective steering axis and the second transfer area is pivotable about a respective tilt-trim axis.

21. The exhaust assembly of claim 20 wherein the first transfer area is configured to pass a relatively high amount of exhaust during periods when the propulsion unit is operated in a generally straight steering condition and the second transfer area is configured to pass a relatively high amount of exhaust during periods when the propulsion unit is operated in a generally trimmed down condition.

22. The exhaust assembly of claim 19 wherein the gimbal housing comprises an outlet configured to allow liquid exhaust to pass therethrough, the outlet being positioned ahead of the first transfer area.

23. The exhaust assembly of claim 19 further comprising a passageway in communication with the exhaust passage, the passageway terminating in one or more venting orifices situated above the water line on the exterior of the boat as the engine is operated in an idling condition.

24. The exhaust assembly of claim 23 wherein the exhaust passage comprises respective exhaust branches that split from the first transfer area through a respective lateral section of the gimbal ring.

25. The exhaust assembly of claim 24 wherein each respective branch of the exhaust passage and the passageway are integrally constructed in the gimbal ring.

26. A method for routing exhaust in a stern drive having an engine located in the interior of a boat, the engine having an exhaust discharge member in communication with a propulsion unit, the method comprising:

providing an exhaust passage having first and second transfer areas connected to pass exhaust from the discharge member to the propulsion unit through a gimbal ring;

pivotally connecting the first transfer area between a gimbal housing and the gimbal ring; and pivotally connecting the second transfer area between a pivot housing and the gimbal ring.

27. The method of claim 26 wherein the first transfer area is pivotable about a respective steering axis and the second transfer area is pivotable about a respective tilt-trim axis.

28. The method of claim 27 further comprising configuring the first transfer area to enable passage of a relatively high amount of exhaust during periods when the propulsion unit is operated in a generally straight steering condition.

29. The method of claim 28 further comprising configuring the second transfer area to enable passage of a relatively high amount of exhaust during periods when the propulsion unit is operated in a generally trimmed down condition.

30. The method of claim 26 further comprising providing an outlet configured to pass liquid exhaust ahead of the first transfer area.

31. The method of claim 30 further comprising providing a passageway in communication with the exhaust passage, the passageway terminating in one or more venting orifices situated above the water line on the exterior of the boat as the engine is operated in an idling condition.

32. The method of claim 31 wherein the exhaust passage comprises respective exhaust branches that split from the first transfer area through a respective lateral section of the gimbal ring.

33. The method of claim 32 further comprising integrally-constructing each respective branch of the exhaust passage and the passageway in the gimbal ring.

34. An assembly for routing exhaust in a stern drive having an engine located in the interior of a boat, the engine having an exhaust discharge member in communication with a propulsion unit, the assembly comprising:

exhaust passage means for passing exhaust from the discharge member to the propulsion unit through a gimbal ring;

means for pivotally connecting a first transfer area of the exhaust passage between a gimbal housing and the gimbal ring; and means for pivotally connecting a second transfer area of the exhaust passage between a pivot housing and the gimbal ring.

35. The assembly of claim 34 further comprising means for enabling passage through the first transfer area of a relatively high amount of exhaust during periods when the propulsion unit is operated in a generally straight steering condition.

36. The assembly of claim 35 further comprising means for enabling passage of a relatively high amount of exhaust through the second transfer area during periods when the propulsion unit is operated in a generally trimmed down condition.

37. The assembly of claim 34 further comprising means for passing liquid exhaust ahead of the first transfer area.

38. The assembly of claim 34 further comprising means for venting the exhaust passage means.

39. The assembly of claim 38 wherein the means for venting is situated above the water line on the exterior of the boat as the engine is operated in an idling condition.

40. A propulsion system comprising:

an engine located in the interior of a marine vessel, the engine having an exhaust discharge member in communication with a propulsion unit; and a gimbal ring having a pivotable smooth exhaust passage connected to pass exhaust from the discharge member to the propulsion unit.

* * * * *